US005668419A

United States Patent [19]

Oktay

[11] Patent Number: 5,668,419

[45] Date of Patent: Sep. 16, 1997

[54] RECONFIGURABLE CONNECTOR

[75] Inventor: Osman Ozay Oktay, Irvine, Calif.

[73] Assignee: Canon Information Systems, Inc., Costa Mesa, Calif.

[21] Appl. No.: 497,108

[22] Filed: Jun. 30, 1995

[51] Int. Cl.[6] ..... H01H 47/00

[52] U.S. Cl. ..... 307/126; 307/125; 307/140; 395/284; 395/311; 439/188

[58] Field of Search ..... 395/283, 284, 395/311; 439/188; 307/112, 113, 116, 125, 126, 130, 131, 139, 140, 147, 149

[56] References Cited

U.S. PATENT DOCUMENTS

| | | | |
|---|---|---|---|
| 4,313,176 | 1/1982 | Cecil | 374/96 |
| 4,641,261 | 2/1987 | Dwyer et al. | 364/900 |
| 4,660,170 | 4/1987 | Hui et al. | 395/311 |
| 4,972,470 | 11/1990 | Farago | 380/3 |
| 5,060,140 | 10/1991 | Brown et al. | 364/200 |
| 5,101,498 | 3/1992 | Ehlig et al. | 395/800 |
| 5,111,423 | 5/1992 | Kopec, Jr. et al. | 395/500 |
| 5,157,769 | 10/1992 | Eppley et al. | 395/200.01 |
| 5,261,116 | 11/1993 | Agrawal | 395/800 |
| 5,274,795 | 12/1993 | Vachon | 395/500 |
| 5,276,443 | 1/1994 | Gates et al. | 395/822 |
| 5,359,717 | 10/1994 | Bowles et al. | 395/325 |
| 5,379,382 | 1/1995 | Work et al. | 395/275 |
| 5,386,518 | 1/1995 | Reagle et al. | 395/325 |

*Primary Examiner*—William M. Shoop, Jr.
*Assistant Examiner*—Jonathan S. Kaplan
*Attorney, Agent, or Firm*—Fitzpatrick, Cella, Harper & Scinto

[57] ABSTRACT

A reconfigurable connector for a peripheral device, which has a first standard configuration in which data is sent and received, and which has a second configuration in which data is sent and received, and in which power is supplied to an interfaced device through a predefined signal pin on the reconfigurable connector. Included in the reconfigurable connector are a controller and a sensor which senses a predetermined signal. In response to the predetermined signal, the controller alters a configuration of the reconfigurable connector from the first standard configuration to the second configuration. In the first standard configuration, the predefined signal pin is configured to provide to the interfaced device a signal which indicates that the peripheral device is supplied with power. In the second configuration, the predefined signal pin is configured to supply power to the interfaced device.

14 Claims, 5 Drawing Sheets

RECONFIGURABLE CONNECTOR

BACKGROUND OF THE INVENTION

1. Field of the Invention

The present invention relates to a connector for a peripheral device, and, more particularly, to a reconfigurable connector which can be configured to supply power from the peripheral device to a device which is interfaced with the connector.

2. Description of the Related Art

Conventionally, a device interfaced with a parallel port of a peripheral device receives power from an external power source via a power adapter. One example of such a device is a network dongle.

A network dongle, also known as a network expansion device, is an adapter that plugs into a parallel port of a network peripheral device, such as a printer, for the purpose of connecting the network peripheral device to a network. An example of a network dongle installed into a standard parallel port of a printer is shown in FIG. 1.

More specifically, FIG. 1 shows dongle 81 interfaced with standard parallel connector 11 of printer 10. FIG. 1 further shows that a conventional network dongle, such as network dongle 81, requires connection to a network via network cable 82 and to an external power source (not shown) via power cord 84 and power adapter 90.

Power adapter 90 converts power from an external power source to power that can be used by the network dongle. However, a major concern for manufacturers of network dongles is both power cord 84 and power adapter 90, which output EMI emissions which possibly can interfere with broadcast communications. These EMI emissions can be a problem for the manufacturer when the network dongle undergoes standardized testing.

Additionally, the cost of manufacturing the network dongle increases greatly due to the cost of power adapter 90.

Moreover, the power adapter and the power cord also make it more difficult to use the network dongle with a peripheral device since the extra power cord and power adapter means that at least one extra power outlet is required. This requirement for an extra power outlet can become a problem due to the size of the power adapter which may cover many power outlets on a power strip, especially in the case where the peripheral device to which the network dongle is connected has multiple power connections which require many of the power outlets on the power strip.

Thus, there exists a need for a peripheral device interface connector which permits not only the interfacing of signals, but also the transfer of power from the peripheral device to an interfaced device, such as a network dongle, so as to eliminate the need, by the interfaced device, for an external power source and thus for an external power adapter for and a power cord.

SUMMARY OF THE INVENTION

The present invention addresses the foregoing need by providing a reconfigurable connector for a peripheral device, which can be configured so as to pass power from the peripheral device to an interfaced device. Because the reconfigurable connector passes power from the peripheral device to the interfaced device, the need for an external power source, and thus for a power adapter and a power cord for the interfaced device, is eliminated.

Thus, according to one aspect, the present invention is a reconfigurable connector for a peripheral, which has a first standard configuration in which data is sent and received, and which has a second configuration in which data is sent and received and in which power is supplied to an interfaced device through a predefined signal pin on the reconfigurable connector. Included in the reconfigurable connector are a sensor which senses a predetermined signal and a controller. In response to the predetermined signal, the controller alters a configuration of the reconfigurable connector from the first standard configuration to the second configuration. In the first standard configuration, the predefined signal pin is configured to provide to the interfaced device a signal which indicates that the peripheral device is supplied with power. In the second configuration, the predefined signal pin is configured to supply power to the interfaced device.

Advantageously, the foregoing reconfigurable connector eliminates the need for an external power source for a device which is interfaced to a peripheral device. Thus, proximity of an external power source for the interfaced device is eliminated as a concern when deciding where to physically locate the peripheral device.

According to another aspect, the present invention is a reconfigurable connector for a peripheral device. The reconfigurable connector has a plurality of signal pins for transmitting data between the peripheral device and an interfaced device and a reconfigurable high signal pin, which, in a first configuration, transmits a power status signal to the interfaced device, and which, in the second configuration, transmits power to the interfaced device. Included in the reconfigurable connector are a reconfigurable high signal pin and a plurality of connection pins which receive predetermined signals from an interfaced device when the interfaced device is connected to the peripheral. The reconfigurable high signal pin has a first configuration in which the reconfigurable high signal pin supplies a signal to the interfaced device indicating that the peripheral device is supplied with power and a second configuration in which the reconfigurable high signal pin supplies power from the peripheral to the interfaced device. A controller receives the predetermined signal from the plurality connection pins, and, in response to the predetermined signals, alters a configuration of the reconfigurable high signal pin from the first configuration to the second configuration.

According to still another aspect, the present invention is a reconfigurable connector for a peripheral which has a first standard configuration in which data is sent and received and which has a second configuration in which data is sent and received and in which power is supplied to an interfaced device through a predefined signal pin on the reconfigurable connector Included in the reconfigurable connector are an optical sensor which includes a continuously radiating light beam, the optical sensor sensing a break in the continuously radiating light beam caused by the interfaced device, and a controller which, in response to a sensed break in the continuously radiating light beam, alters a configuration of the reconfigurable connector from the first standard configuration to the second configuration. In the first standard configuration, the predefined signal pin is configured to provide to the interfaced device a signal which indicates that the peripheral device is supplied with power, and in the second configuration, the predefined signal pin is configured to supply power to the interfaced device.

According to still another aspect, the present invention is a printer having a reconfigurable connector. The printer includes a printer engine for generating images based on print data received by the reconfigurable connector, and a parallel port connector having a plurality of signal pins through which print data is received from an interfaced device, a predefined signal pin which signals to the interfaced device that the printer is supplied with power, and at least two standard isolated ground pins which ground the parallel port connector with the interfaced device. A sensor connected to the at least two standard isolated ground pins senses a predetermined signal received by the at least two standard isolated ground pins, and a controller outputs a control signal to configure the predefined signal pin from a first standard configuration to a second configuration in response to receipt of the predetermined signal. A power switch switches the predefined signal pin from the first standard configuration to the second configuration upon receiving the control signal from the controller. When the reconfigurable connector is in the first standard configuration, the predefined signal pin is configured to provide to the interfaced device a signal which indicates that the peripheral device is supplied with power, and when the reconfigurable connector is in the second configuration, the predefined signal pin is configured to supply power to the interfaced device. In the first standard configuration, the power switch is open so as to prevent power from passing through the predefined signal pin, and, in the second configuration, the power switch is closed so as to supply power from the printer to the interfaced device.

This brief summary has been provided so that the nature of the invention may be understood quickly. A more complete understanding of the invention can be obtained by reference to the following detailed description of the preferred embodiments thereof in connection with the attached drawings.

DETAILED DESCRIPTION OF THE PREFERRED EMBODIMENTS

[First Embodiment]

The reconfigurable connector of the present invention utilizes a standard parallel connector physical pin arrangement, as described in *Centronics Engineering Standard,* Number 9, Revision B, Genicom Corp., Apr. 9, 1980 (e.g., Amphenol 57-40360 or its equivalent), *IBM Personal Computer Technical Reference Options And Adapters Manual,* Number 6322509, IBM Corp., and *Standard Signalling Method For Bi-Directional Parallel Peripheral Interface For Personal Computers,* IEEE-1284 (1994). Likewise, when operating in its default configuration, also called a first standard configuration, the reconfigurable connector utilizes standard pin assignments, which are also described in *Centronics Engineering Standard, IBM Personal Computer Technical Reference Options And Adapters Manual,* and *Standard Signalling Method For Bi-Directional Parallel Peripheral Interface For Personal Computers* cited above.

The first standard configuration pin assignments include a plurality of output signal pins, through which the peripheral device passes data and other electrical signals to the interfaced device; a high signal pin, through which the peripheral device passes a power status signal to the interfaced device; and at least two ground pins which have been modified to receive signals from the interfaced device.

The reconfigurable connector of the present invention also operates in a second configuration when a device having pin assignments identical to those of a Canon® network dongle is connected to the reconfigurable connector of the present invention. The pin assignments for a Canon® network dongle are identical to those for a standard parallel interface, except that one of the ground pins, for example, ground pin #2 (GND2), is provided with a predetermined signal, such as a "high" signal, (or is left open), rather than a ground connection.

In the first standard configuration of the reconfigurable connector, data is sent and received and, in the second configuration, data is sent and received and power is supplied to an interfaced device through a predefined signal pin on the reconfigurable connector. Included in the reconfigurable connector are a sensor which senses a predetermined signal and a controller which, in response to the predetermined signal, alters a configuration of the reconfigurable connector from the first standard configuration to the second configuration. In the first standard configuration, the predefined signal pin is configured to provide to the interfaced device a signal which indicates that the printer is supplied with power, and in the second configuration, the predefined signal pin is configured to supply power to the interfaced device.

Figure 1:
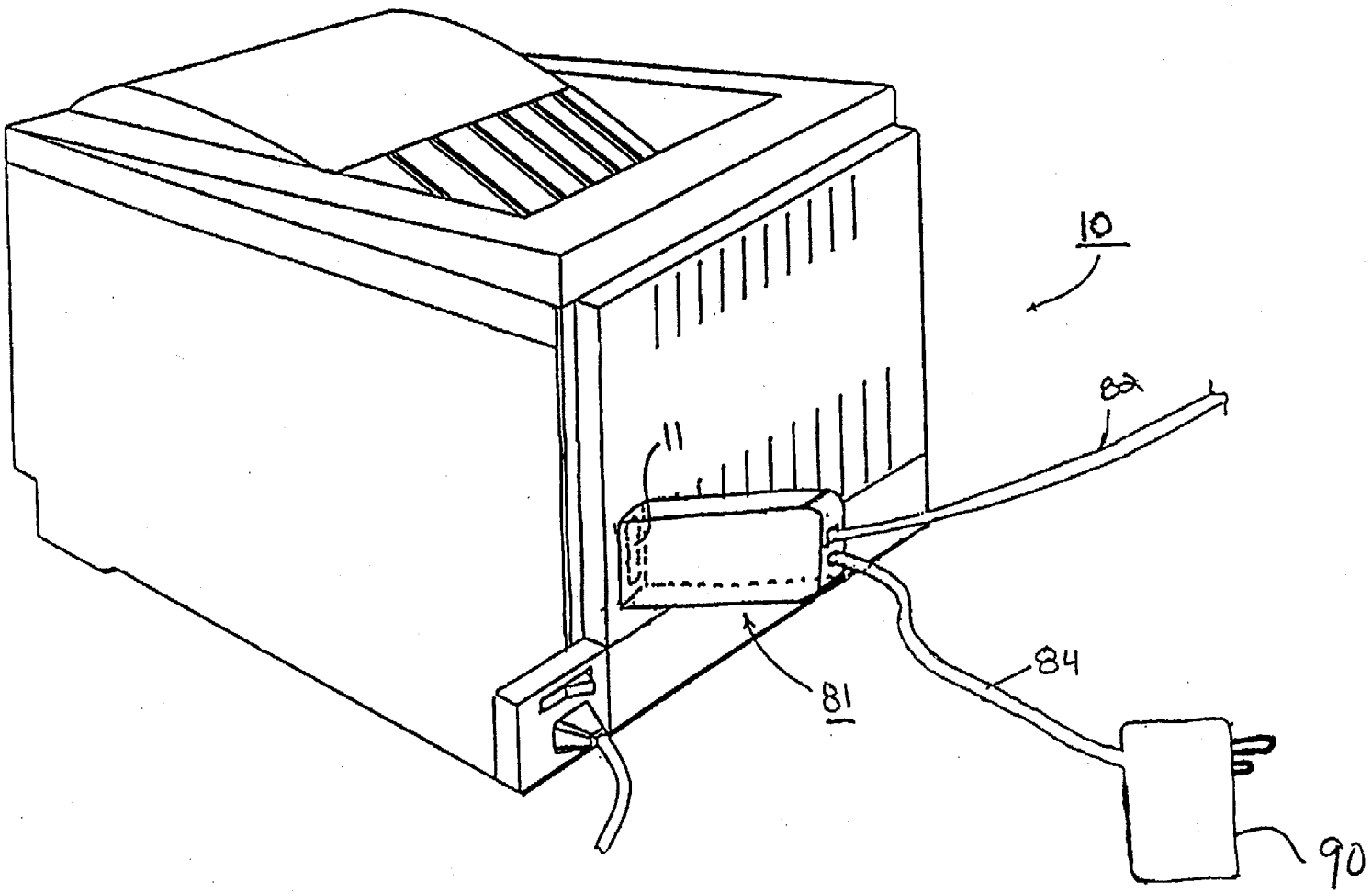
FIG. 1 (PRIOR ART)
FIG. 1 shows a conventional network dongle connected to a laser printer having a standard parallel port, to a network and to a power adapter.
Figure 2:
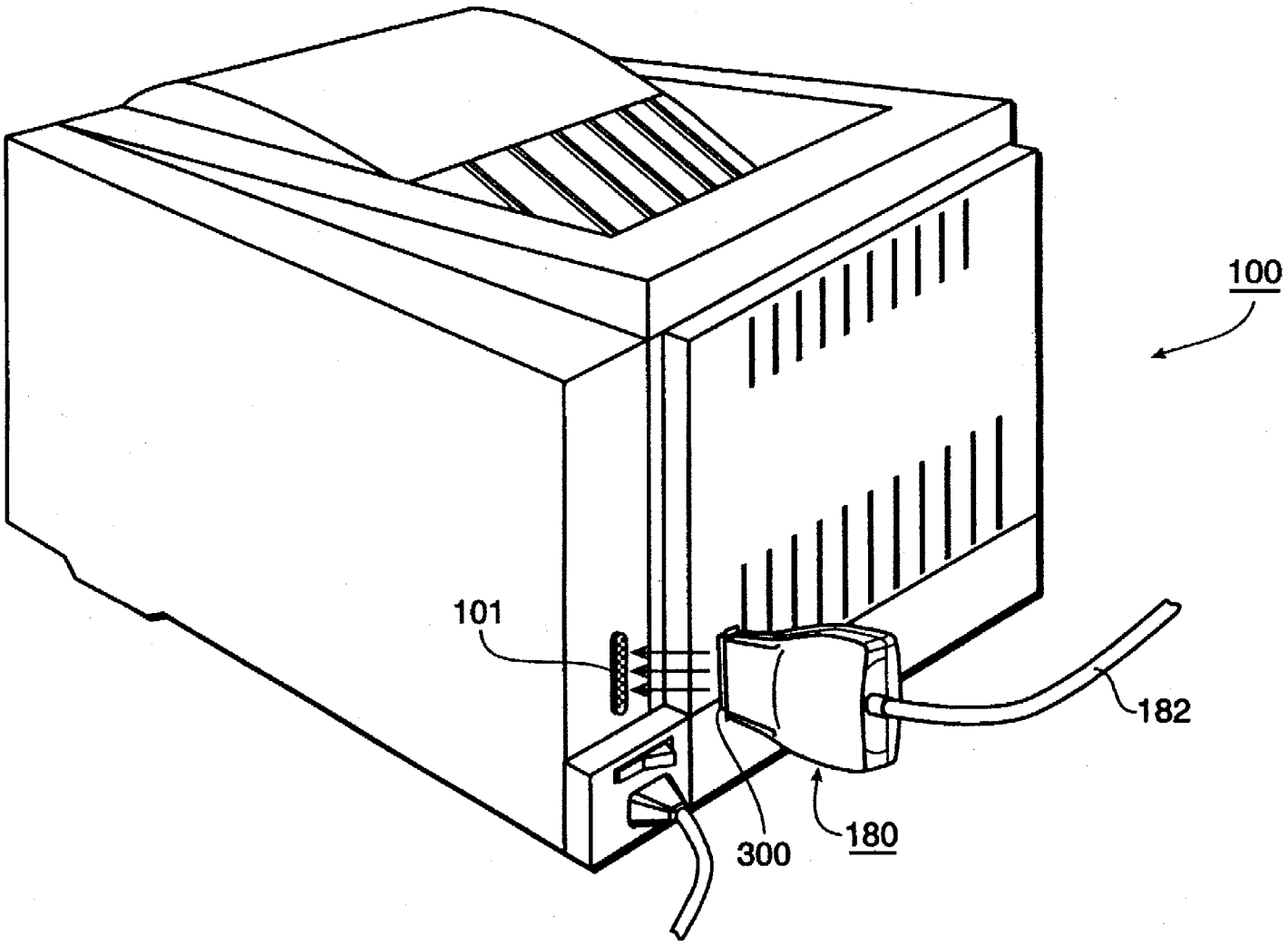
FIG. 2 shows a Canon® network dongle interfacing to a laser printer having the reconfigurable connector of the present invention and to a network.

FIG. 2 shows an overall view of reconfigurable connector 101 of the present invention installed in printer 100. Printer 100 includes printer engine 170 (shown in FIG. 3) which generates print data and which transmits the print data, along with control signals, from printer 100 to dongle 180 via reconfigurable connector 101. As shown in FIG. 2, dongle 180, which connects to reconfigurable connector 101, is also connected to a network via network cable 182.

It is noted that while FIG. 2 shows reconfigurable connector 101 in connection with a printer, i.e., printer 100, reconfigurable connector 101 can be used with any commercially available peripheral device which has a connector which can be modified as discussed below. For example, reconfigurable connector 101 can be used in a facsimile machine, a copier, a scanner, a personal computer and the like.

Additionally, while FIG. 2 depicts reconfigurable connector 101 as female connector, it is noted that the reconfigurable connector of the present invention can also be a male connector.

Figure 3:
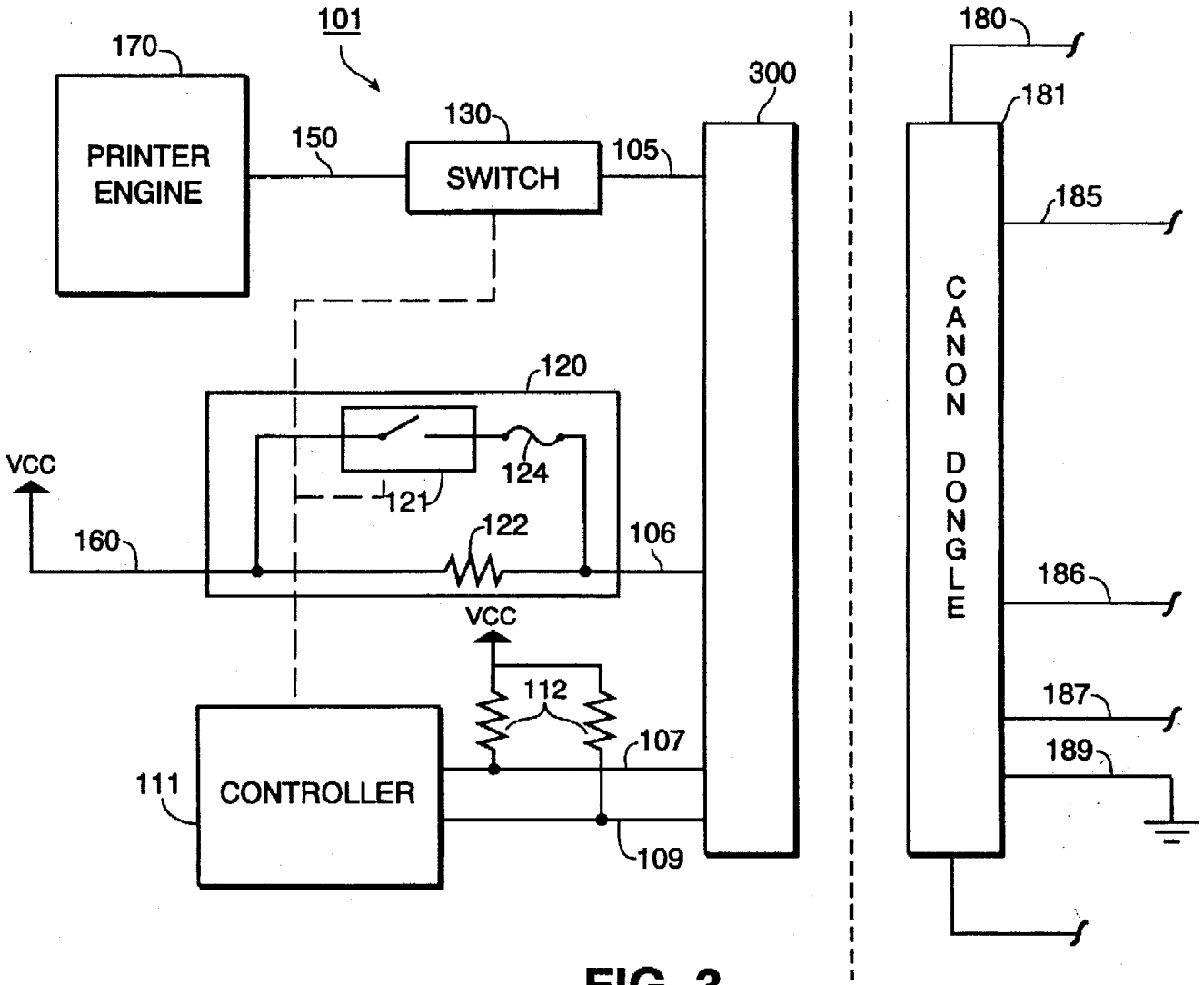
FIG. 3 is a schematic circuit diagram which shows an interface between a first embodiment of the reconfigurable connector of the present invention and a Canon® network dongle.

FIG. 3 shows a schematic circuit diagram of the circuitry of reconfigurable connector 101 and parallel connector 181 of dongle 180.

Included in reconfigurable connector 101 is output signal pin 105, which is one of a plurality of output signal pins in the reconfigurable connector, through which data is passed from printer 100 to dongle 180. The number and function of such output signal pins are defined in *Centronics Engineering Standard,* Number 9, Revision B, Genicom Corp., Apr.

9, 1980, *IBM Personal Computer Technical Reference Options And Adapters Manual,* Number 6322509, IBM Corp., and *Standard Signalling Method For Bi-Directional Parallel Peripheral Interface For Personal Computers,* IEEE-1284 (1994). Since the other output signal pins in the plurality of output signal pins are identical in both structure and function to output signal pin 105, a detailed description thereof is omitted for the sake of brevity.

When not interfaced with a compatible connector, reconfigurable connector 101 returns to a default state. A compatible connector 300 is a connector which mates to reconfigurable connector 101 and which includes either ground connections at ground pins 107 and 109 or a ground connection at ground pin 109 and a predetermined signal at ground pin 107.

In the default state, reconfigurable connector 101 is in the first standard configuration, and all output signal pins, such as output signal pin 105, are disabled, so as to prevent damage to inputs of a not yet powered-up interfaced device. Output signal pin 105 remains disabled until controller 111 enables output signal pin 105. Controller enables output signal pin when it detects that a compatible connector is connected to reconfigurable connector 101 and is powered-up.

When output signal pin 105 is enabled, in both the first standard configuration and the second configuration of reconfigurable connector 101, output signal pin 105 is able to pass data and control signals from printer 100 to an interfaced device, such as dongle 180.

Reconfigurable connector 101 further includes high signal pin 106. In the first standard configuration of reconfigurable connector 101, high signal pin 106 is conventionally used to transmit a power status signal to an interfaced device. For example, when interfaced with a personal computer, high signal pin 106 transmits a power status signal (a logic high signal) to the personal computer, which indicates that power is supplied to the printer. Of course, if power is not supplied to the printer, the personal computer will not receive a signal from high pin 106 which will result in an error message being displayed to the user. Thus, the personal computer uses the power status signal to determine the operational status of the printer. In the second configuration of reconfigurable connector 101, however, high signal pin 106 is reconfigured to supply power to an interfaced device, in this case, dongle 180.

Additionally, reconfigurable connector 101 includes isolated ground pin 107 and isolated ground pin 109. However, these pins have been modified by using pull-up resistors 112 which permit the detection of electrical signals, such as a predetermined signal. As described below, this predetermined signal is used to configure reconfigurable connector 101 into the second configuration.

Output signal pin 105 interfaces to input signal pin 185 on dongle 180. Input signal pin 185 is one of a plurality of input signal pins, through which dongle 180 receives data and control signals from printer 100.

High signal pin 106 interfaces to high signal pin 186 on dongle 180. High signal pin 186 receives a power status signal from printer 100 when reconfigurable connector 101 is in the first standard configuration, and receives power from printer 100 when reconfigurable connector 101 is in the second configuration.

Ground pins 107 and 109 interface to ground pins 187 and 189, respectively, on dongle 180. In the case of a Canon® network dongle, such as dongle 180, ground pin 187 is provided with a predetermined signal. If dongle 180 were not a Canon® network dongle, ground pin 187 would be connected to ground. In either case, ground pin 189 is connected to ground.

Controller 111 configures reconfigurable connector 101 based on signals received by ground pins 107 and 109 from ground pins 187 and 189 on network dongle 180. In a preferred embodiment, controller 111 comprises control logic gates, such as "AND" gates, "OR" gates, or a combination thereof. Alternatively, controller 111 could comprise a microprocessor, such as an Intel 8086 microprocessor.

FIG. 3 also shows power circuitry 120, which includes switch 121, resistor 122 and fuse 124. Power circuitry 120 operates to configure high signal pin 106 to provide either power or a power status signal in response to a signal from controller 111. In this regard, in the first standard configuration, high signal pin 106 is tied to logic high and, when reconfigured into the second configuration, power circuitry 120 permits printer 100's +5V (VCC) power from power line 160 to be passed through to an interfaced device via high signal pin 106.

In a preferred embodiment of the present invention, switch 121 is a transistor which has a collector an emitter and a base, which acts as a closed circuit when a signal is supplied to the base and which acts as an open circuit when no such signal is supplied.

Fuse 124 regulates power from power line 160 when switch 121 is closed in order to prevent power surges to high signal pin 106. Preferably, fuse 124 is a temperature-dependent fuse that acts as an open circuit at high temperatures and that acts as a closed circuit at low temperatures.

Switch 130, also shown in FIG. 3, is connected to output signal pin 105 and to printer signal line 150. The function of switch 130 is to prevent damage to electrical circuitry of an unpowered interfaced device. This is accomplished by opening switch 130, thereby effectively disabling output signal pin 105. It is noted that a switch equivalent in both structure and function to switch 130 is provided for each output signal pin on reconfigurable connector 101 which is identical to output signal pin 105.

In this regard, switch 130 can be a tri-state gate, which controller 111 controls between a low impedance state and a high impedance state in which, in the high impedance state, a signal is prevented from being sent via output signal pin 105.

Now, a brief explanation will be provided with respect to FIG. 3 as to the operation of reconfigurable connector 101.

In operation, reconfigurable connector 101 is defaulted to the first standard configuration. Likewise, all output signal pins, including output signal pin 105, are disabled and can only be enabled by a signal received from controller 111. Thus, when an interfaced device having a standard parallel interface is connected to reconfigurable connector 101, reconfigurable connector 101 remains in the first standard configuration and output signal pin 105 remains disabled until controller 111 identifies the signals received by ground pins 107 and 109 (e.g., 0,0) and enables output signal pin 105.

Controller 111 enables output signal pin 105 by closing switch 130, so as to permit transfer of data and control signals from printer 100 to an interfaced device via output signal pin 105. Likewise reconfigurable connector 101 remains in the first standard configuration in which power switch 121 in an open state so as to prevent power from being supplied through high pin 106 and so as to permit transfer of a power status signal to an interfaced device via high signal pin 106.

In operation with a Canon® network dongle, such as dongle 180, reconfigurable connector 101 is configured into the second configuration. More specifically, when controller 111 detects a predetermined signal at ground pin 107, controller 111 closes power switch 121 so as to permit transfer of power to dongle 180 via high signal pin 106, and after waiting a predetermined period of time, closes switch 130 so as to permit data and control signals to be transferred to dongle 180 via output signal pin 105. The predetermined period of time is set so as to permit VCC power to stabilize upon transfer to dongle 180.

A more detailed description of the functionality and operation of the present invention will be described hereinbelow with respect to FIGS. 3 and 4.

Figure 4:
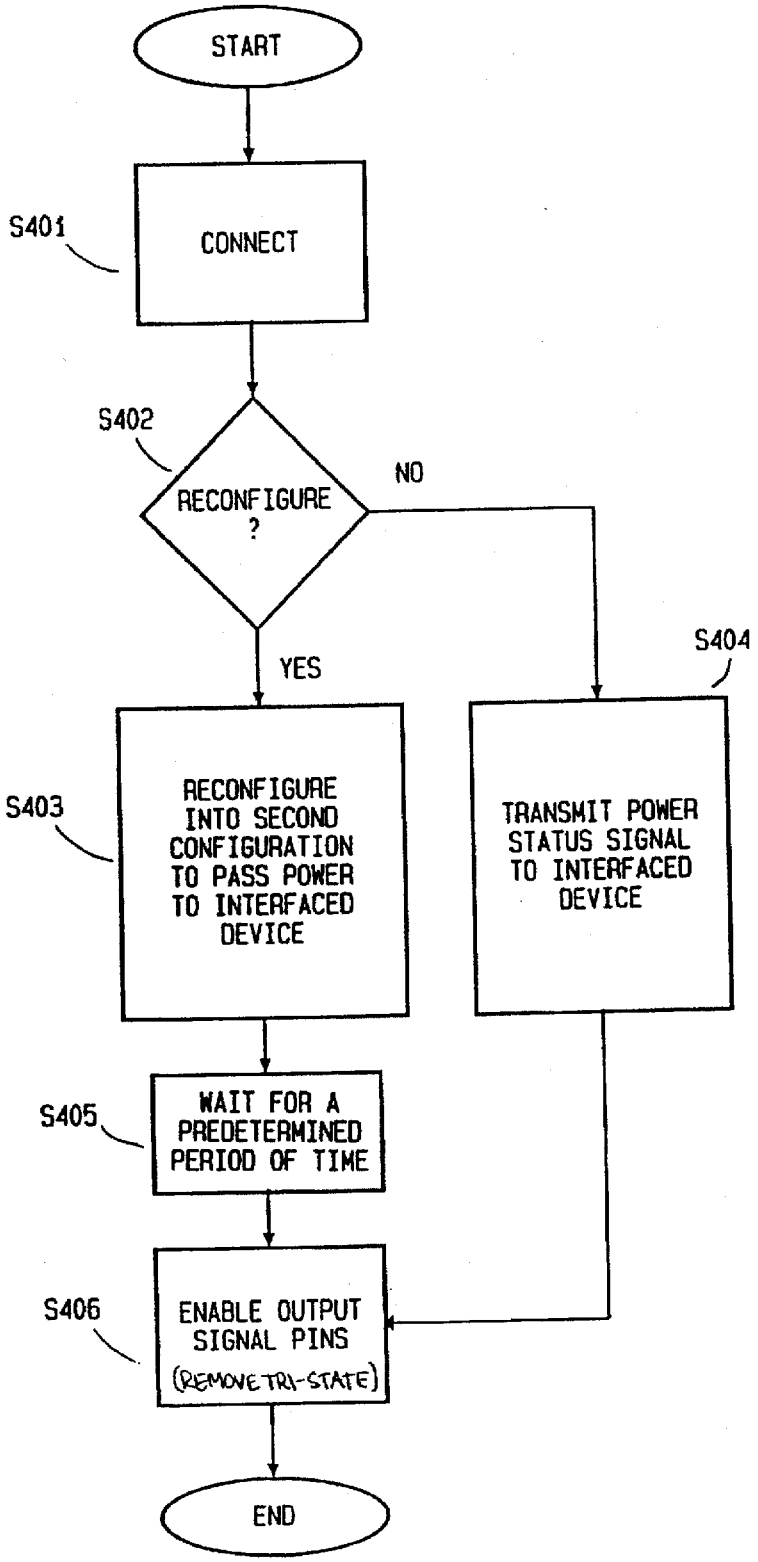
FIG. 4 is a flow diagram which shows process steps for configuring the reconfigurable connector of the present invention.

FIG. 4 is a flow diagram showing the operation of reconfigurable connector 101. In step S401, controller 111 determines that an interfaced device is connected to reconfigurable connector 101. Controller 111 does this by monitoring ground pins 107 and 109 for either a predetermined signal or a ground connection.

Once controller 111 determines that an interfaced device is connected to reconfigurable connector 101, in step S402, controller 111 determines whether reconfigurable connector 101 should be configured.

More specifically, when controller 111 senses a ground connection at ground pin 107, controller 111 determines that a standard parallel interface connector is connected to reconfigurable connector 101. In this case, since reconfigurable connector 101 is always defaulted to the first standard configuration, reconfigurable connector 101 is not reconfigured.

In the first standard configuration, switch 121 is open. Thus, in the first standard configuration, VCC power is not supplied to the interfaced device via high signal pin 106. Rather, as shown in step S404, a power status signal is supplied to high signal pin 106 through resistor 122. This power status signal indicates to the interfaced device that printer 100 is supplied with power.

In step S406, output signal pin 105 is enabled, in order to permit transmittal of data and control signals, by closing switch 130. As described above, when closed, switch 130 permits transfer of data and control signals from printer 100 to dongle 180 via output signal pin 105.

If, in step S402, controller 111 senses a predetermined signal, which is not a ground connection, at ground pin 107 and ground at ground pin 109, controller 111 determines that a Canon® network dongle is connected to reconfigurable connector 101. When a Canon® network dongle is connected to reconfigurable connector 101, controller 111 configures reconfigurable connector 101 into the second configuration.

More specifically, in step S403, controller 111 closes switch 121. As shown in FIG. 3, when switch 121 is closed, +5V VCC power is passed from high signal pin 106 to high signal pin 186 of dongle 180.

Thus, in the second configuration, reconfigurable connector 101 passes power from printer 100 to dongle 180. As a result, dongle 180 no longer requires power from an external power source. Dongle 180 is therefore free to be installed into any peripheral when equipped with the present invention, regardless of the peripheral's proximity to a power source for the dongle. In addition, because the need for an external power source is eliminated, no power adapter or power cord is required for dongle 180.

Next, in step S405, controller 111 waits a predetermined period of time so as to permit VCC power to stabilize upon transfer to dongle 180.

Following power stabilization, in step S406, controller 111 enables output signal pin 105. Since this step is identical to that described above, a description of this step is omitted here, for the sake of brevity.

[Second Embodiment]

The second embodiment of the present invention is a reconfigurable connector for a peripheral which has a first standard configuration in which data is sent and received and which has a second configuration in which data is sent and received and in which power is supplied to an interfaced device through a predefined signal pin on the reconfigurable connector. Included in the reconfigurable connector are an optical sensor which includes a continuously radiating light beam, the optical sensor sensing a break in the continuously radiating light beam caused by the interfaced device, and a controller which, in response to a sensed break in the continuously radiating light beam, alters a configuration of the reconfigurable connector from the first standard configuration to the second configuration. In the first standard configuration, the predefined signal pin is configured to provide to the interfaced device a signal which indicates that the peripheral device is supplied with power, and in the second configuration, the predefined signal pin is configured to supply power to the interfaced device.

Figure 5:
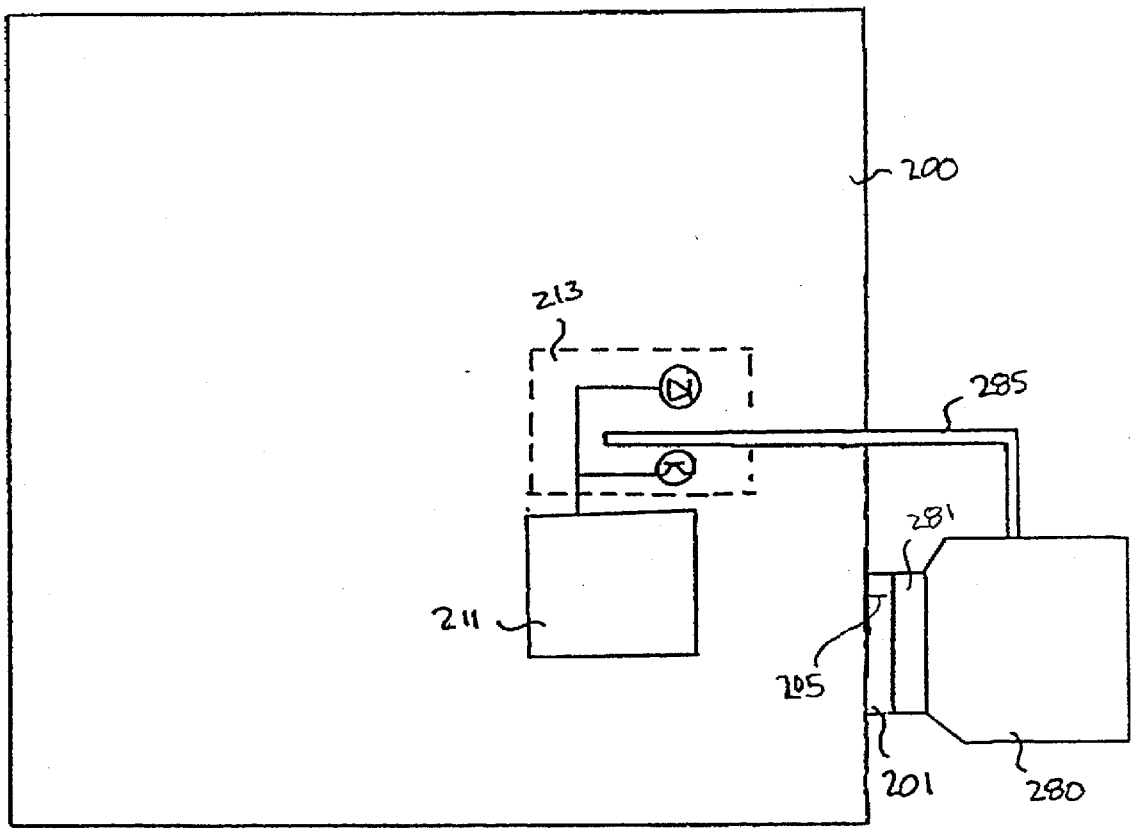
FIG. 5 is a diagram showing an interface between a second embodiment of the reconfigurable connector of the present invention and an interfaced device having a distal arm.
Figure 1:
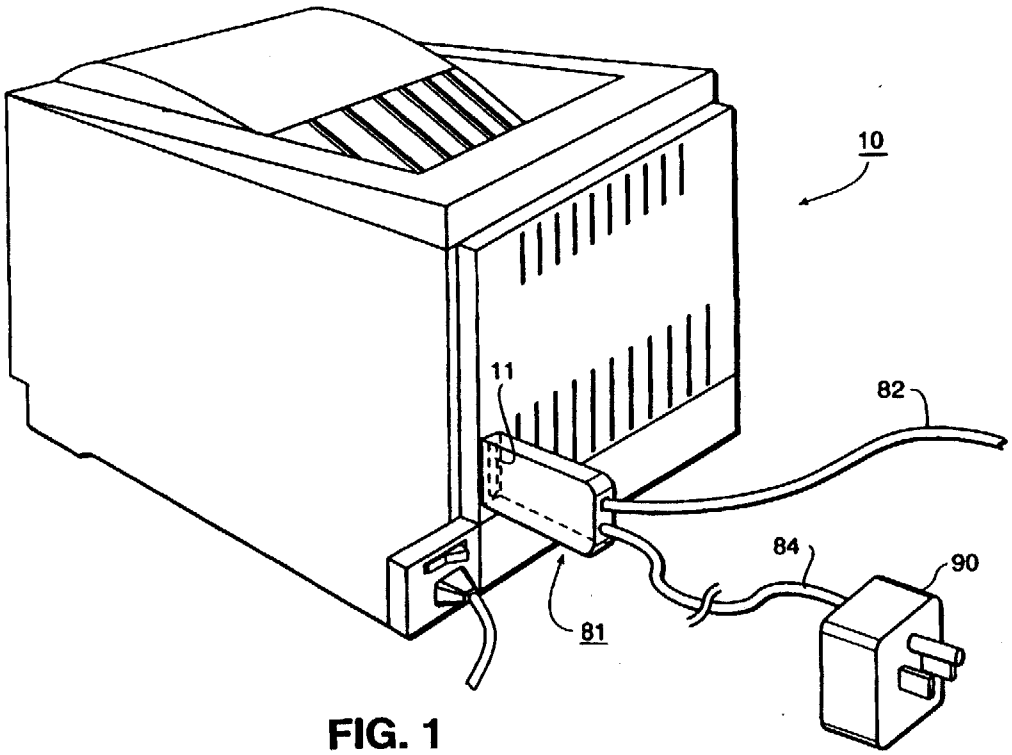
FIG. 1 (PRIOR ART)
Figure 2:
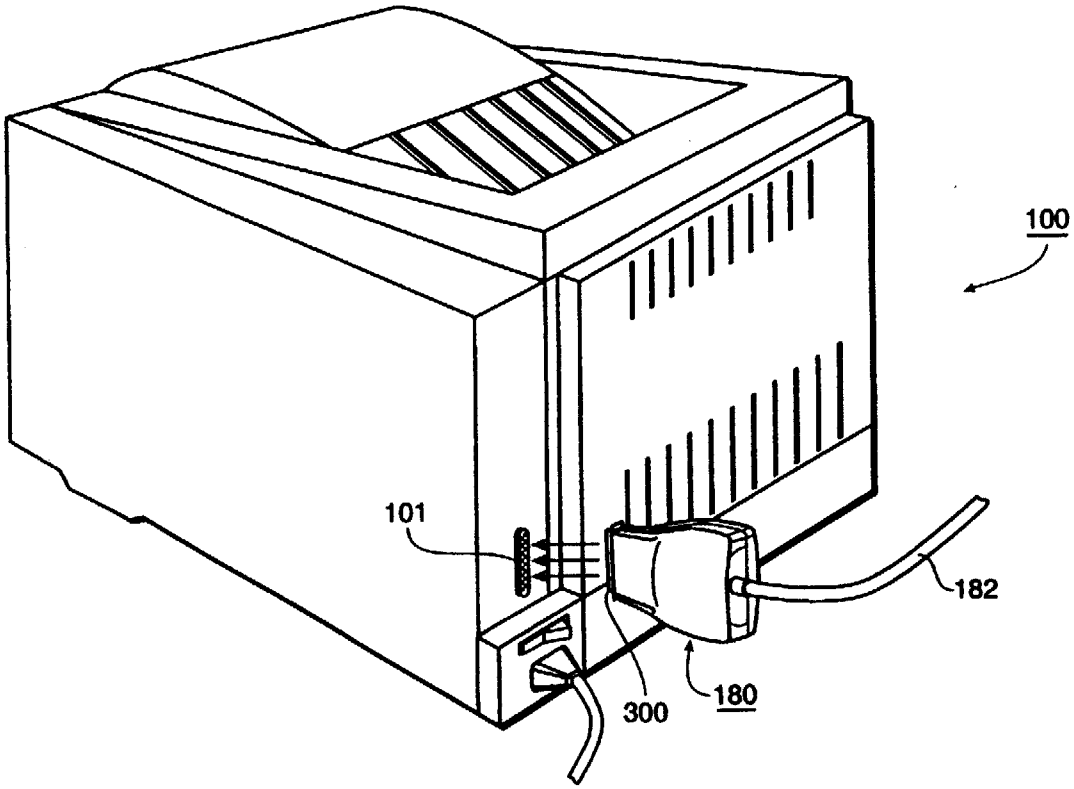
Figure 3:
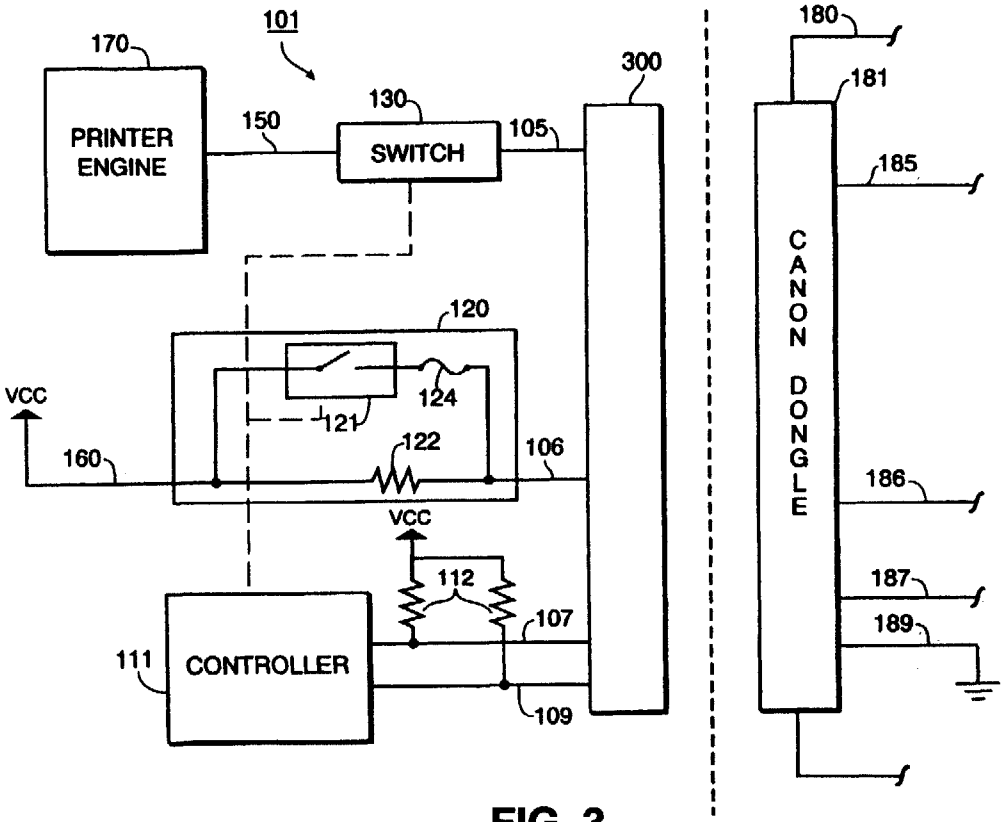
Figure 4:
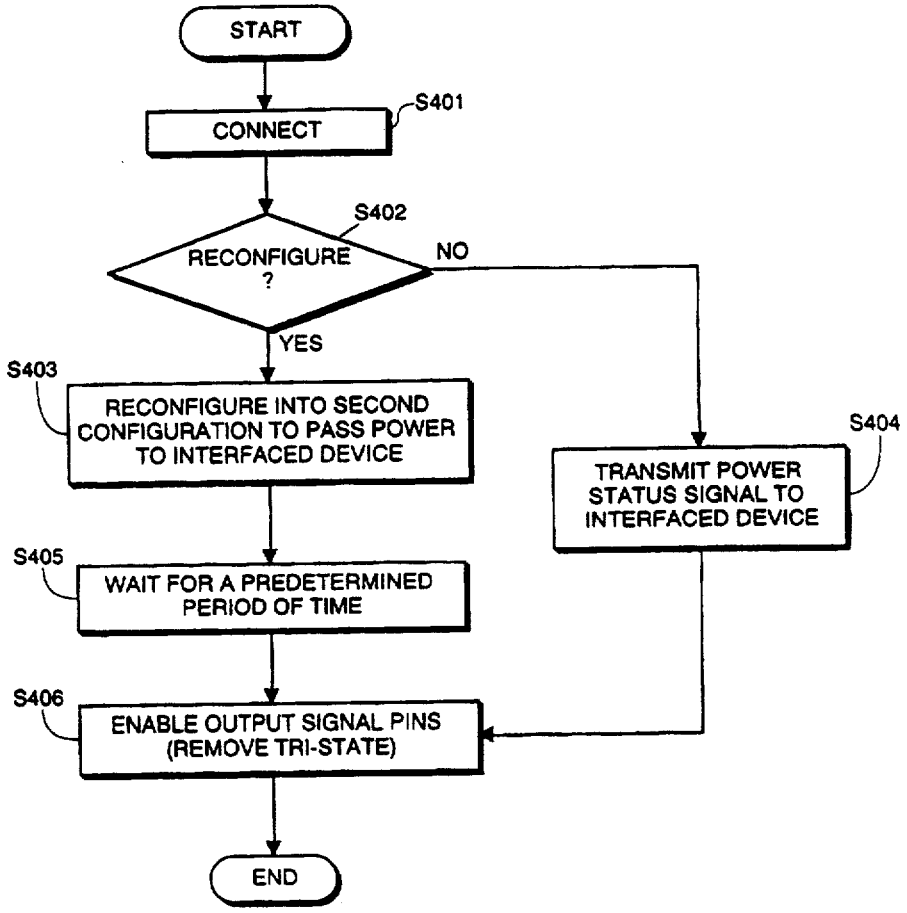
Figure 5:
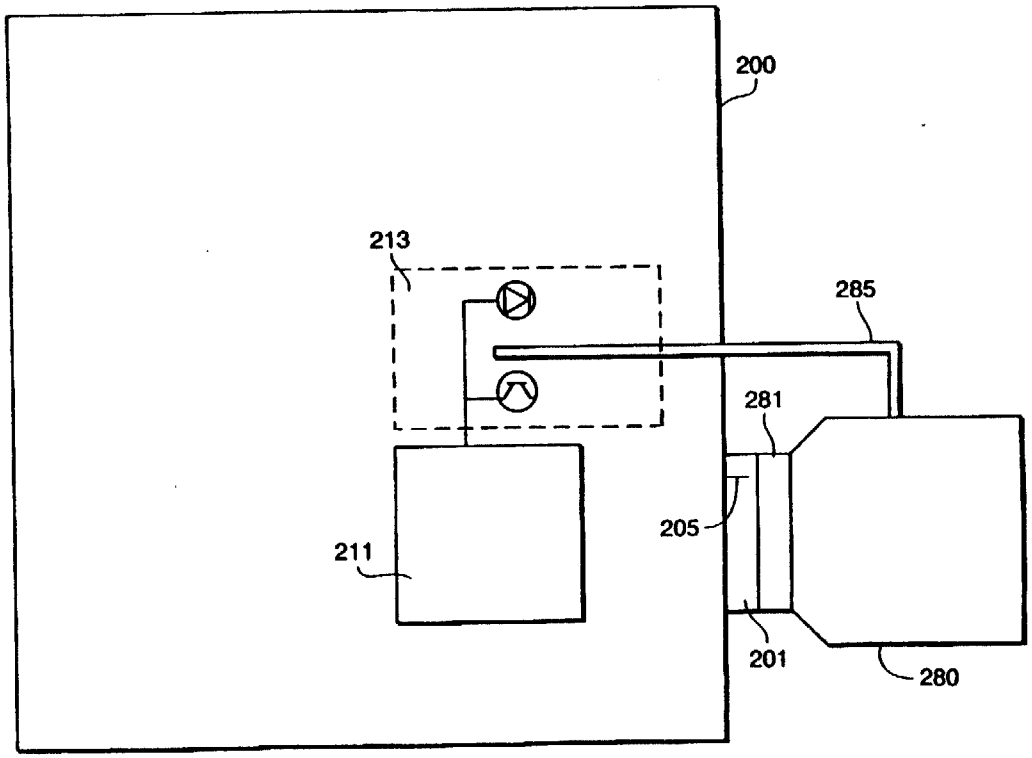

FIG. 5 shows reconfigurable connector 201, which is a second embodiment of the present invention, interfaced to a dongle having distal arm 285. All of the features of reconfigurable connector 201, except controller 211, are identical in both structure and function to like features shown in FIG. 3. Accordingly, a detailed description thereof is omitted for the sake of brevity.

As shown in FIG. 5, reconfigurable connector 201 includes optical circuitry 213. Optical circuitry 213 includes a light emitting circuit element, which is capable of continuously radiating a light beam, and an optically-sensitive circuit element which is capable of receiving the radiated light beam. One example of a light emitting circuit element is a light emitting diode (LED) and one example of an optically-sensitive circuit element is a photodiode.

Upon being interfaced with a dongle having a distal arm, such as dongle 280 having distal arm 285, but before mating of reconfigurable connector 201 to connector 281, the light beam in optical circuitry 213 is broken by distal arm 285. In response, optical circuitry 213 outputs a signal to controller 211. Upon receiving the signal, controller 211 is informed that dongle 280 is being connected to reconfigurable connector 210. Once controller 211 determines that dongle 280 is being connected to reconfigurable connector 201, controller 211 disables output signal pin 205 of reconfigurable connector 201. That is, controller 211 outputs a control signal to a switch (not shown) which is similar to switch 130, discussed previously, in order to disable output signal pin 205. As mentioned above with respect to the first embodiment, output signal pin 205 is one of a plurality of output signal pins on reconfigurable connector 201, which are identical in both structure and function to the output signal pins of the first embodiment.

After reconfigurable connector 201 mates with connector 281 on dongle 280, controller 211 reconfigures reconfigurable connector 201 to supply power to dongle 280 through a power pin (not shown), which is identical in both structure and function to power pin 106. Controller 211 also enables output signal pin 205 after a predetermined time so as to permit transfer of data and control signals from printer 200 to dongle 280. Controller 211 does this in the same manner as was described above with respect to the first embodiment, i.e., by closing a switch (or by enabling the tri-state gate). Thereafter, the function of controller 211 is identical to that of controller 111 described above. For the sake of brevity, a detailed description of controller 211's functionality is omitted.

When an interfaced device which does not have distal arm 280 is connected to reconfigurable connector 210, reconfigurable connector 201 is not configured into the second configuration, since the light beam in optical circuitry 213 will not be obstructed. Thus, reconfigurable connector 201 remains in the first standard configuration.

It should be noted that the second embodiment of the present invention is not limited to the foregoing optical system for detecting an interfaced device connected to reconfigurable connector 201. Rather, the second embodiment could be modified so as to employ any type of mechanical and/or electro-mechanical or any other feedback as an indication that dongle 280 or its equivalent is connected to reconfigurable connector 201.

The reconfigurable connector of the present invention is described above with respect to a dongle. However, it is noted that the reconfigurable connector of the present invention can interface to any type of device which interfaces to the parallel port of a peripheral, regardless of whether the device interfaces to, or can interface to, a network.

Likewise, the reconfigurable connector of the present invention can have a physical pin arrangement other than that of a standard parallel connector, so long as the reconfigurable connector includes a pin which can supply power to an interfaced device.

While preferred embodiments of the invention have been described, it is to be understood that the invention is not limited to the above-described embodiments and that various changes and modifications may be made by those of ordinary skill in the art without departing from the spirit and scope of the invention.

What is claimed is:

1. A reconfigurable connector for a peripheral device, said reconfigurable connector having a first standard configuration in which data is sent and received and having a second configuration in which data is sent and received and in which power is supplied to an interfaced device through a predefined signal pin on said reconfigurable connector, said reconfigurable connector comprising:

a controller which senses a predetermined signal and which, in response to the predetermined signal, alters a configuration of said reconfigurable connector from the first standard configuration to the second configuration;

wherein, when said reconfigurable connector is in the first standard configuration, the predefined signal pin is configured to provide to the interfaced device a signal which indicates that the peripheral device is supplied with power, and wherein, when said reconfigurable connector is in the second configuration, the predefined signal pin is configured to supply power to the interfaced device.

2. A reconfigurable connector according to claim 1, wherein the predetermined signal comprises an electrical signal received from the interfaced device, and wherein said controller senses the predetermined signal when the interfaced device is connected to said reconfigurable connector.

3. A reconfigurable connector according to claim 1, further comprising sensing circuitry through which said controller senses the predetermined signal, and wherein said controller responds to the predetermined signal by causing said reconfigurable connector to be reconfigured from the first standard configuration to the second configuration.

4. A reconfigurable connector according to claim 3, wherein said controller comprises a microprocessor which monitors the sensing circuitry to determine if the predetermined signal has been sensed and which, in a case that the predetermined signal has been sensed, reconfigures the predefined signal pin so as to supply power to the interfaced device.

5. A reconfigurable connector according to claim 3, further comprising:

a power switch, controlled by said controller, which switches the function of the predefined signal pin from the first standard configuration to the second configuration, wherein, in the first standard configuration, said power switch is open so as to prevent power from passing through the predefined signal pin, and wherein, in the second configuration, said power switch is closed so as to supply power from the peripheral device to the interfaced device.

6. A reconfigurable connector according to claim 3, further comprising:

signal pins which pass data between the peripheral device and the interfaced device, wherein said signal pins are maintained in a disabled state, and wherein said controller enables said signal pins after waiting a predetermined period of time when said controller determines that a compatible connector is connected to said reconfigurable connector.

7. A reconfigurable connector for a peripheral device, said reconfigurable connector having a plurality of signal pins for transmitting data between the peripheral device and an interfaced device and having a reconfigurable signal pin, said reconfigurable connector comprising:

a plurality of connection pins, through which the interfaced device transmits predetermined signals to the peripheral device when the interfaced device is connected to the peripheral device; and a controller which receives the predetermined signals from said plurality of connection pins, and which, in response to the predetermined signals, alters a configuration of said reconfigurable signal pin from a first configuration to a second configuration, wherein, when in the first configuration, the reconfigurable signal pin supplies a signal to the interfaced device indicating that the peripheral device is supplied with power, and, when in the second configuration, said reconfigurable signal pin supplies power from the peripheral device to the interfaced device.

8. A reconfigurable connector according to claim 7, further comprising:

a power switch disposed between the peripheral device and said reconfigurable signal pin and controlled by said controller, wherein, in the first configuration, said power switch is open so as to prevent power from being supplied to the reconfigurable signal pin, and wherein in the second configuration said power switch is closed so as to supply power from the peripheral device to the interfaced device via said reconfigurable signal pin.

9. A reconfigurable connector according to claim 8, wherein said power switch comprises a transistor having a collector, an emitter and a base, and wherein said controller supplies a control signal to the base of the transistor when said controller receives the predetermined signal so as to permit power to be transmitted from the peripheral device across the transistor to the interfaced device.

10. A reconfigurable connector according to claim 7, wherein the plurality of signal pins are disabled for a predetermined time upon being interfaced to a compatible connector so that electrical signals are prevented from being transmitted via the plurality of signal pins, and after the predetermined time, the plurality of signal pins are enabled so as to permit electrical signals to be transmitted via the plurality of signal pins.

11. A reconfigurable connector according to claim 10, further comprising:

a plurality of switches disposed between the peripheral device and the plurality of signal pins, and controlled by said controller, wherein, upon being interfaced with the compatible connector, said plurality of switches are open for a predetermined time so as to prevent electrical signals from being transmitted via the plurality of signal pins, and after the predetermined time, said plurality of switches are closed so as to permit electrical signals to be transmitted via the plurality of signal pins.

12. A reconfigurable connector for a peripheral device, said reconfigurable connector having a first standard configuration in which data is sent and received and having a second configuration in which data is sent and received and in which power is supplied to an interfaced device through a predefined signal pin on said reconfigurable connector, said reconfigurable connector comprising:

an optical sensor which includes a continuously radiating light beam, said optical sensor sensing a break in the continuously radiating light beam caused by the interfaced device; and a controller which, in response to a sensed break in the continuously radiating light beam, alters a configuration of said reconfigurable connector from the first standard configuration to the second configuration;

wherein, when said reconfigurable connector is in the first standard configuration, the predefined signal pin is configured to provide to the interfaced device a signal which indicates that the peripheral device is supplied with power, and wherein, when said reconfigurable connector is in the second configuration, the predefined signal pin is configured to supply power to the interfaced device.

13. A printer connectable to an interfaced device that provides the printer with print data, the printer comprising:

a printer engine for generating images based on the print data received from the interfaced device;

a parallel port connector having a plurality of signal pins through which the print data is received from the interfaced device and provided to the printer engine, said parallel port connector further having a predefined signal pin which signals to the interfaced device that the printer is supplied with power or which provides power to the interfaced device, and at least two standard isolated ground pins which ground the parallel port connector with the interfaced device;

a controller connected to said at least two standard isolated ground pins for sensing a predetermined signal received by said least two standard isolated ground pins, which, in response to receipt of the predetermined signal, outputs a control signal to configure said predefined signal pin from a first standard configuration to a second configuration; and a power switch which switches the predefined signal pin from the first standard configuration to the second configuration upon receiving the control signal from said controller, wherein, when said predefined signal pin is in the first standard configuration, the predefined signal pin is configured to provide to the interfaced device a signal which indicates that the printer is supplied with power, and wherein, when said predefined signal pin is in the second configuration, the predefined signal pin is configured to supply power to the interfaced device; and wherein, when the predefined signal pin is in the first standard configuration, the power switch is open so as to prevent power from passing through the predefined signal pin, and, when the predefined signal pin is in the second configuration, the power switch is closed so as to supply power from the printer to the interfaced device.

14. A printer according to claim 13, wherein said parallel port connector comprises a standard Centronics connector.

* * * * *

UNITED STATES PATENT AND TRADEMARK OFFICE

CERTIFICATE OF CORRECTION

PATENT NO. : 5,668,419

DATED : September 16, 1997

INVENTOR(S) : Oktay

It is certified that error appears in the above-identified patent and that said Letters Patent is hereby corrected as shown below:

Delete Drawings sheets 1-5, and substitute therefor the Drawings sheets, consisting of Figs. 1-5, as shown on the attached sheets.

Signed and Sealed this

Sixteenth Day of June, 1998

*Attest:*

Bruce Lehman

BRUCE LEHMAN

*Attesting Officer*

*Commissioner of Patents and Trademarks*